US011395977B2

(12) United States Patent
Pruzansky et al.

(10) Patent No.: US 11,395,977 B2
(45) Date of Patent: Jul. 26, 2022

(54) TOY ASSEMBLY AND EXTENSIBLE OBJECT THEREFOR

(71) Applicant: Spin Master Ltd., Toronto (CA)

(72) Inventors: Amy A. Pruzansky, Toronto (CA); Arta Alagheband, Toronto (CA); Franklin La Barbara, Rumford, RI (US)

(73) Assignee: SPIN MASTER LTD., Toronto (CA)

( * ) Notice: Subject to any disclaimer, the term of this patent is extended or adjusted under 35 U.S.C. 154(b) by 125 days.

(21) Appl. No.: 16/791,167

(22) Filed: Feb. 14, 2020

(65) Prior Publication Data

US 2020/0261814 A1 Aug. 20, 2020

Related U.S. Application Data

(60) Provisional application No. 62/806,755, filed on Feb. 15, 2019.

(51) Int. Cl.
*A63H 13/02* (2006.01)
*A63H 3/00* (2006.01)
(Continued)

(52) U.S. Cl.
CPC ..... *A63H 13/02* (2013.01); *A63H 3/008* (2013.01); *A63H 3/46* (2013.01); *A63H 3/52* (2013.01); *A63H 13/16* (2013.01); *A63H 29/24* (2013.01)

(58) Field of Classification Search
CPC ..... A63H 13/02; A63H 13/16; A63H 3/008; A63H 3/46; A63H 3/52; A63H 3/005; A63H 3/50; A63H 29/24; A63H 33/26
See application file for complete search history.

(56) References Cited

U.S. PATENT DOCUMENTS 1,567,973 A 12/1925 Mendelson
2,157,199 A * 5/1939 Doering ..... G09F 15/0081 40/473
(Continued)

FOREIGN PATENT DOCUMENTS

CN 2762847 Y 3/2006
CN 201073548 Y 6/2008
(Continued)

OTHER PUBLICATIONS

EP20157529, European Search Report, European Patent Office, dated Jun. 9, 2020.
(Continued)

*Primary Examiner* — Eugene L Kim
*Assistant Examiner* — Alyssa M Hylinski
(74) *Attorney, Agent, or Firm* — Aird & McBurney LP

(57) ABSTRACT

In an aspect, a toy assembly is provided, and includes a toy assembly housing, an extensible object inside the toy assembly housing, an extension mechanism, and an extension member power source. The extensible object includes a base, and first and second extension members. The extension mechanism is operable to drive the first and second extension members towards extended positions, and is operatively connected to the second extension member via a lost motion connection. Driving of the extension mechanism by the extension mechanism power source drives the first extension member towards the extended position for the first extension member to break or open the toy assembly housing to expose the extensible object while consuming at least a portion of the lost motion in the lost motion connection. Upon consuming the lost motion, further driving the extension mechanism drives the first and second extension members towards the extended positions.

8 Claims, 14 Drawing Sheets

(51) Int. Cl.

| | |
|---|---|
| ***A63H 3/46*** | (2006.01) |
| ***A63H 3/52*** | (2022.01) |
| ***A63H 29/24*** | (2006.01) |
| ***A63H 13/16*** | (2006.01) |

(56) References Cited

U.S. PATENT DOCUMENTS

| | | | | |
|---|---|---|---|---|
| 2,985,975 | A * | 5/1961 | Sidney | G09F 15/0087 40/470 |
| 4,073,383 | A * | 2/1978 | Rummer | A47F 7/166 40/473 |
| 5,310,380 | A * | 5/1994 | Levy | A63H 3/36 446/370 |
| 6,247,991 | B1 * | 6/2001 | Chen | A63H 33/00 74/89.22 |
| 6,312,308 | B1 * | 11/2001 | Chen | A63H 33/00 428/3 |
| 6,422,915 | B1 * | 7/2002 | Chen | A63H 33/00 446/175 |
| 6,755,715 | B2 * | 6/2004 | Wong | A47G 33/06 40/610 |
| 2001/0034178 | A1 | 10/2001 | Spector | |
| 2002/0098770 | A1 | 7/2002 | Mesch | |
| 2017/0106297 | A1 | 4/2017 | Hashemi et al. | |

FOREIGN PATENT DOCUMENTS

| | | | | |
|---|---|---|---|---|
| CN | 204601607 | U | 9/2015 | |
| CN | 205759703 | U | 12/2016 | |
| CN | 206965123 | U | 2/2018 | |
| CN | 207928712 | U | 10/2018 | |
| CN | 212016715 | U | 11/2020 | |
| GB | 1301201 | A | 12/1972 | |
| WO | WO-2006006673 | A1 * | 1/2006 | A63H 13/16 |

OTHER PUBLICATIONS

EP20157529, Communication pursuant to Article 94(3), European Patent Office, dated Jul. 3, 2020.

Office Action relating to Chinese Patent Application No. 202010097579.3, dated May 31, 2021.

Extended European Search Report relating to European Patent Application No. 21167493.2, dated Jun. 25, 2021.

* cited by examiner

TOY ASSEMBLY AND EXTENSIBLE OBJECT THEREFOR

CROSS-REFERENCE TO RELATED APPLICATIONS

This application claims the benefit of U.S. Provisional Application No. 62/806,755 filed Feb. 15, 2019, the contents of which are incorporated herein by reference in their entirety.

FIELD OF THE DISCLOSURE

The present disclosure relates to extensible objects, and, in particular, an extensible object that is extensible so as to open a housing so as to expose the extensible object.

BACKGROUND OF THE DISCLOSURE

It is known to provide extensible objects, and, in particular, objects that are extensible and that break out of a housing. An example of this include some of the Hatchimals® line of products. Another example is a toy character that is made from a super-absorbent polymer (SAP), and which resides inside an egg-shaped housing. Immersion of the housing into water causes the toy character to absorb water and expand, eventually breaking out of the housing. However, some of the Hatchimals® products are able to grow, but only to a limited degree, while the toy character made from SAP has relatively limited play value once the breakout process is completed. It would be advantageous to provide a toy assembly with an extensible object that is capable of relatively large amounts of extension.

SUMMARY OF THE DISCLOSURE

In an aspect, a toy assembly is provided, and includes a toy assembly housing, an extensible object inside the toy assembly housing, an extension mechanism, and an extension member power source. The extensible object includes a base, a first extension member that is movable relative to the base between a retracted position for the first extension member and an extended position for the first extension member, and a second extension member that is movable relative to the first extension member between a retracted position for the second extension member and an extended position for the second extension member. The extension mechanism is operable to drive the first extension member towards the extended position for the first extension member and to drive the second extension member towards the extended position for the second extension member. The extension mechanism is operatively connected to the second extension member via a lost motion connection having a selected amount of lost motion. The extension mechanism power source is operatively connected to the extension mechanism to drive the extension mechanism. When the extensible object is in a home position, driving of the extension mechanism by the extension mechanism power source drives the first extension member towards the extended position for the first extension member to break or open the toy assembly housing to expose the extensible object while consuming at least a portion of the lost motion in the lost motion connection so as to prevent movement of the second extension member towards the extended position for the second extension member, while breaking out of the toy assembly housing, by breaking or opening the toy assembly housing. Upon consuming an entirety of the lost motion in the lost motion connection, further driving of the extension mechanism by the extension mechanism power source drives both the first and second extension members towards the extended positions for the first and second extension members.

In another aspect, an extensible object is provided, and includes a base, a first extension member that is movable relative to the base between a retracted position for the first extension member and an extended position for the first extension member, a second extension member that is movable relative to the first extension member between a retracted position for the second extension member and an extended position for the second extension member, and an extension mechanism that is operable to drive the first extension member towards the extended position for the first extension member and to drive the second extension member towards the extended position for the second extension member. The extension mechanism includes at least one drum, a first extension drive cable connected between the at least one drum and the first extension member and passing over a pulley on the base, and a second extension drive cable connected between a second extension drive cable anchor point and the second extension member and passing over a second extension drive cable pulley on the first extension member. The extension mechanism power source is operatively connected to the at least one drum to rotate the at least one drum in a first rotation direction so as to wind the first extension drive cable onto the at least one drum, thereby driving the first extension member toward the extended position for the first extension member, which in turn drives movement of the second extension drive cable pulley, which in turn drives the second extension drive cable to drive movement of the second extension member relative to the first extension member.

BRIEF DESCRIPTION OF THE FIGURES

For a better understanding of the various embodiments described herein and to show more clearly how they may be carried into effect, reference will now be made, by way of example only, to the accompanying drawings.

DETAILED DESCRIPTION

Figure 1:
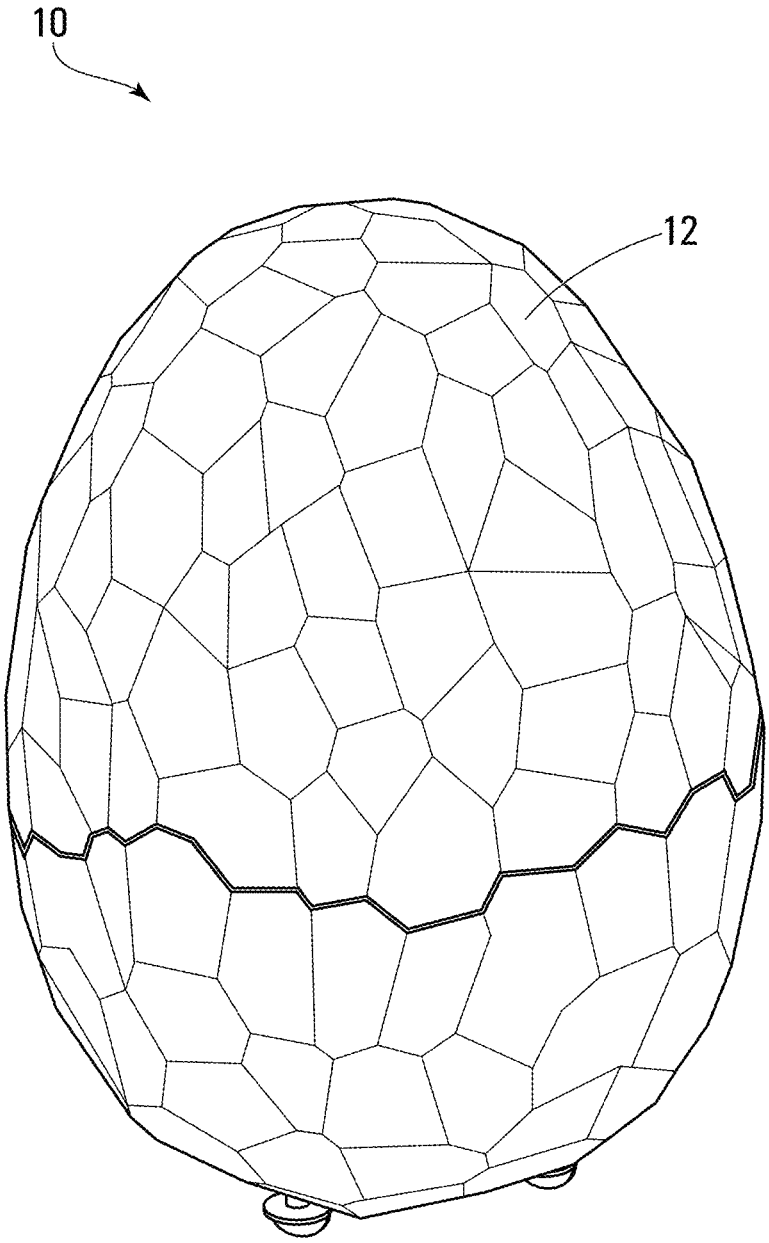
FIG. 1 is a perspective view of a toy assembly according to a non-limiting embodiment of the present disclosure.

For simplicity and clarity of illustration, where considered appropriate, reference numerals may be repeated among the Figures to indicate corresponding or analogous elements. In addition, numerous specific details are set forth in order to provide a thorough understanding of the embodiments described herein. However, it will be understood by those of ordinary skill in the art that the embodiments described herein may be practiced without these specific details. In other instances, well-known methods, procedures and components have not been described in detail so as not to obscure the embodiments described herein. Also, the description is not to be considered as limiting the scope of the embodiments described herein.

Various terms used throughout the present description may be read and understood as follows, unless the context indicates otherwise: "or" as used throughout is inclusive, as though written "and/or"; singular articles and pronouns as used throughout include their plural forms, and vice versa; similarly, gendered pronouns include their counterpart pronouns so that pronouns should not be understood as limiting anything described herein to use, implementation, performance, etc. by a single gender; "exemplary" should be understood as "illustrative" or "exemplifying" and not necessarily as "preferred" over other embodiments. Further definitions for terms may be set out herein; these may apply to prior and subsequent instances of those terms, as will be understood from a reading of the present description.

Reference is made to FIG. 1, which shows a toy assembly 10 in accordance with an embodiment of the present disclosure. The toy assembly 10 includes a includes a housing 12 and an extensible object 14 inside the housing 10. The housing 12 in the embodiment shown is in the form of an egg, however the housing 12 may have any other suitable form, such as a sphere, a cylinder, a box, or any other regular or irregular form.

The housing 12 may be made from any suitable material. In some embodiments the housing 12 may be made from a polymeric material and may include a first housing portion and a second housing portion that is removably mounted to the first housing portion, so as to permit a user to open the housing to access the extensible object 14.

In other embodiments, such as that which is shown, the housing 12 may be made to be breakable which a suitable ease, optionally during expansion of the extensible object 14. Referring to the view in FIG. 2, the housing 12 may include a plurality of fracture paths 16 formed therein. As a result, when the toy character 14 breaks the housing 12 it appears to the user that the housing 12 has been broken irregularly and randomly by the toy character 14, to impart realism to the process of breaking the housing. The irregular fracture paths 16 may have any suitable shape. For example, the fracture paths 16 may have any suitable shape and may be formed in any suitable way. For example, the fracture paths may be molded directly into a circumferential band 18 around the circumference of the housing 12. In the example shown, the fracture paths 16 are provided only on the inside face (shown at 20) of the housing 12 so as to not be visible to the user prior to breakage of the housing 12. As a result of the fracture paths 16, the housing 12 is configured to fracture along at least one of the fracture paths 16 when subjected to a sufficient force. The fracture paths 16 may be formed as paths of localized reduction in the thickness of the housing 12.

The housing 12 may be formed of any suitable natural or synthetic polymer composition, depending on the desired performance (i.e., breakage) properties. When presented in the form of an egg shell, as shown for example in FIG. 1A, the polymer composition may be selected so as to exhibit a realistic breakage behavior upon engagement from the extensible object 14. In general, suitable materials for a simulated breakable egg shell may exhibit one or more of low elasticity, low plasticity, low ductility and low tensile strength. In addition, the polymer composition may be selected to demonstrate breakage without the formation of sharp edges.

An example of a good material is a material that includes about 15-24 weight-% base polymer, about 1-5 weight-% organic acid metal salt and about 75-84 weight-% inorganic/particulate filler. It will be appreciated that a variety of base polymers, organic acid metal salts and fillers may be selected to achieve the desired performance properties. In one exemplary embodiment suitable for use in forming the housing 12, the composition is comprised of 15-24 weight-% ethylene-vinyl acetate, 1-5 weight-% zinc stearate and 75-84 weight-% calcium carbonate. While exemplified using ethylene-vinyl acetate, it will be appreciated that a variety of base polymers may be used depending on the desired performance properties. Alternatives for the base polymer may include select thermoplastics, thermosets and elastomers. For example, in some embodiments, the base polymer may be a polyolefin (i.e., polypropylene, polyethylene). It will be further appreciated that the base polymer may be selected from a range of natural polymers used to produce bioplastics. Exemplary natural polymers include, but are not limited to, starch, cellulose and aliphatic polyesters. While exemplified using calcium carbonate, it will be appreciated that an alternative particulate filler may be suitably used. Exemplary alternatives may include, but are not limited to, talc, mica, kaolin, wollastonite, feldspar, and aluminum hydroxide.

Suitable examples of fracture paths 16 are shown and described in U.S. Pat. No. 9,950,267B2, the contents of which are incorporated herein by reference.

The extensible object 14 may be configured to break the housing 12 from within the housing 12, as to expose the extensible object 14. The extensible object 14 may be in the form of a character, such as an animal, a robot, a person, a fictitious character, an anthropomorphic object or any other suitable type of character. Alternatively, the extensible object 14 may have a form that is not that of a character. In embodiments in which the housing 12 is in the form of an egg, the act of breaking the housing 12 will appear to the user as if the extensible object 14 is hatching from the egg, particular in embodiments in which the toy character 14 is in the form of a bird, or some other animal that normally hatches from an egg, such as a turtle, a lizard, a dinosaur, or some other animal.

Figure 2:
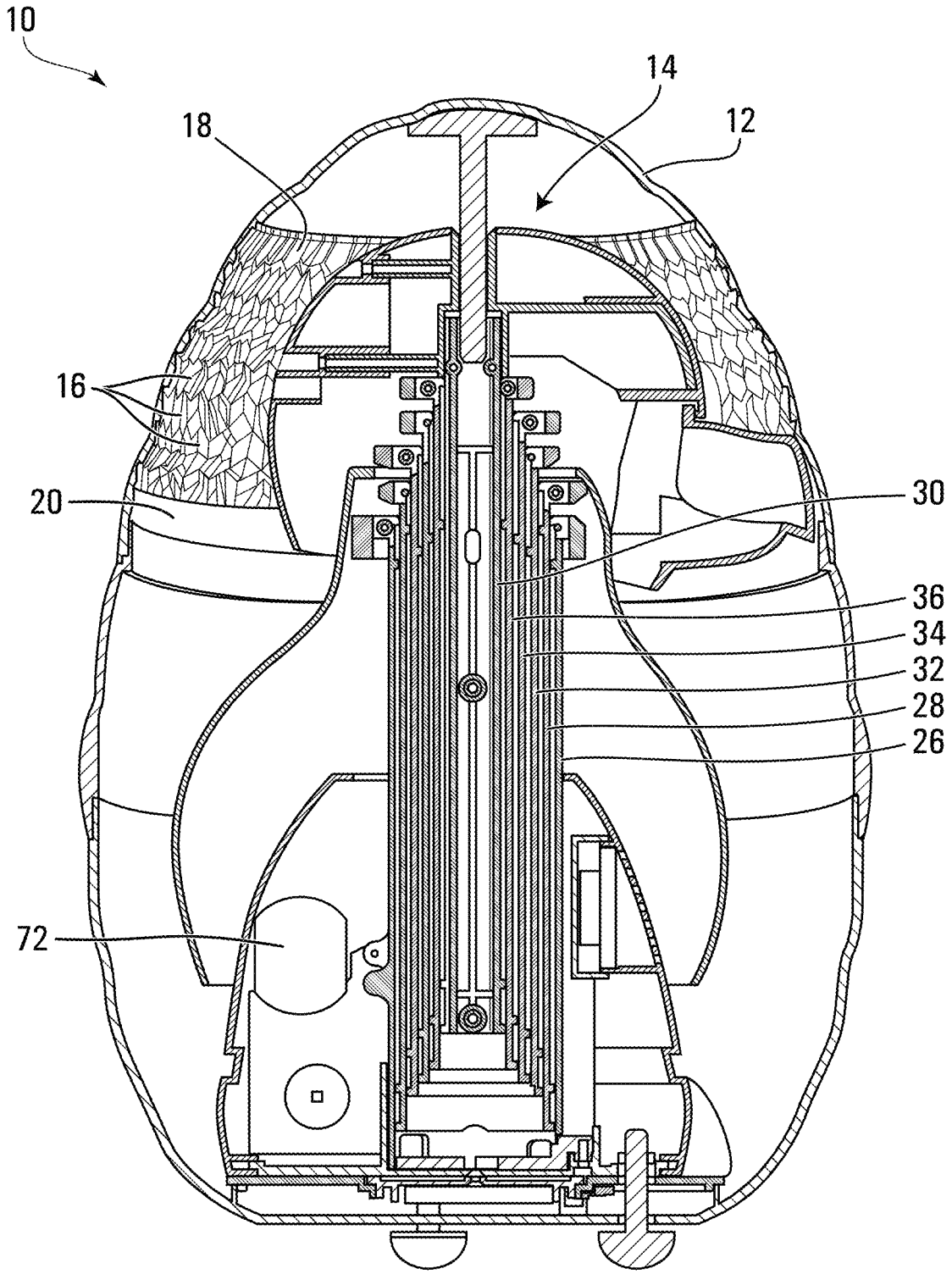
FIG. 2 is a sectional elevation view of the toy assembly shown in FIG. 1, illustrating a housing, and an extensible object that is inside the housing, in a retracted position.
Figure 3:
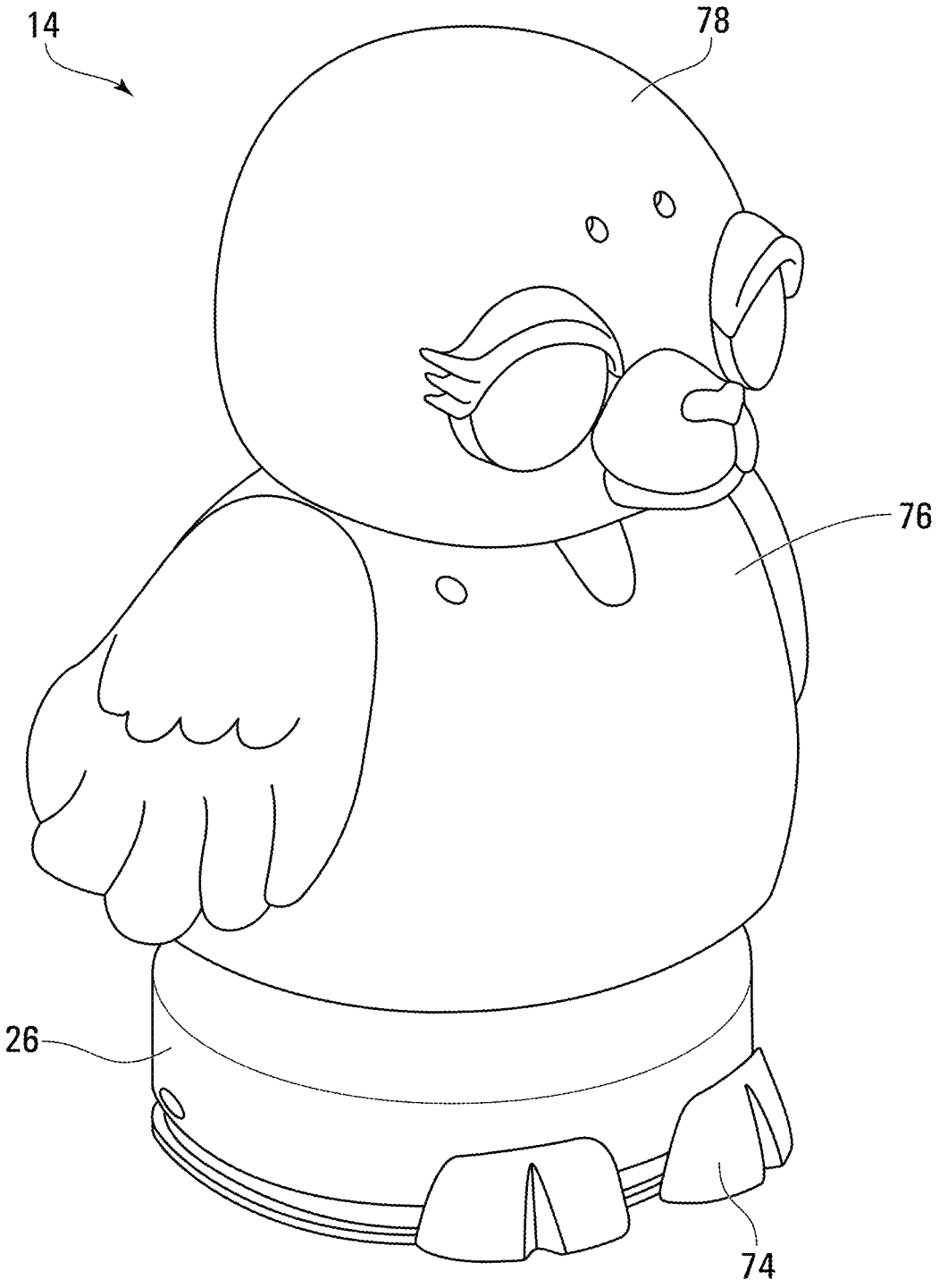
FIG. 3 is a perspective view of the extensible object shown in FIG. 2, in the retracted position.

The extensible object 14 is extensible, in the sense that it is capable of growing in at least one dimension. In the embodiment shown in FIGS. 4-10 the extensible object 14 grows along a first axis 24. Referring to FIG. 2, the extensible object 14 includes a base 26, a first extension member 28 that is movable relative to the base between a retracted position (FIGS. 4, 5 and 6) for the first extension member 28, and an extended position (FIGS. 8 and 10) for the first extension member 28, and a second extension member 30 that is movable relative to the first extension member 28 between a retracted position (FIGS. 4, 5 and 6) for the second extension member 30 and an extended position (FIGS. 8 and 10) for the second extension member 30.

In the embodiment shown in FIGS. 4-10, the extensible object 14 further includes a third extension member 32, a fourth extension member 34 and a fifth extension member 36, each of which is movable between a retracted position (FIGS. 4, 5 and 6) for that extension member and an extended position (FIGS. 8 and 10) for that extension member. Each extension member is movable relative to the base 26 and relative to all the extension members between that extension member and the base 26. Thus, the first extension member 28 is movable relative to the base 26. The third extension member 32 is movable relative to the base 26 and to the first extension member 28. The fourth extension member 34 is movable relative to the base 26 and to the first and third extension members 32 and 34. The fifth extension member 36 is movable relative to the base 26 and to the first, third and fourth extension members 30, 32 and 34. The second extension member 30 is movable relative to the base 26 and to the first, third, fourth and fifth extension members 30, 32, 34 and 36.

In order to permit movement between the various extension members, and between the first extension member 28 and the base 26, suitable bushing members shown at 38 in FIG. 2 may be provided on the extension members and the base 26 as appropriate. The bushing members 38 may be polymeric or may be made from any other suitable low friction material.

Figure 4:
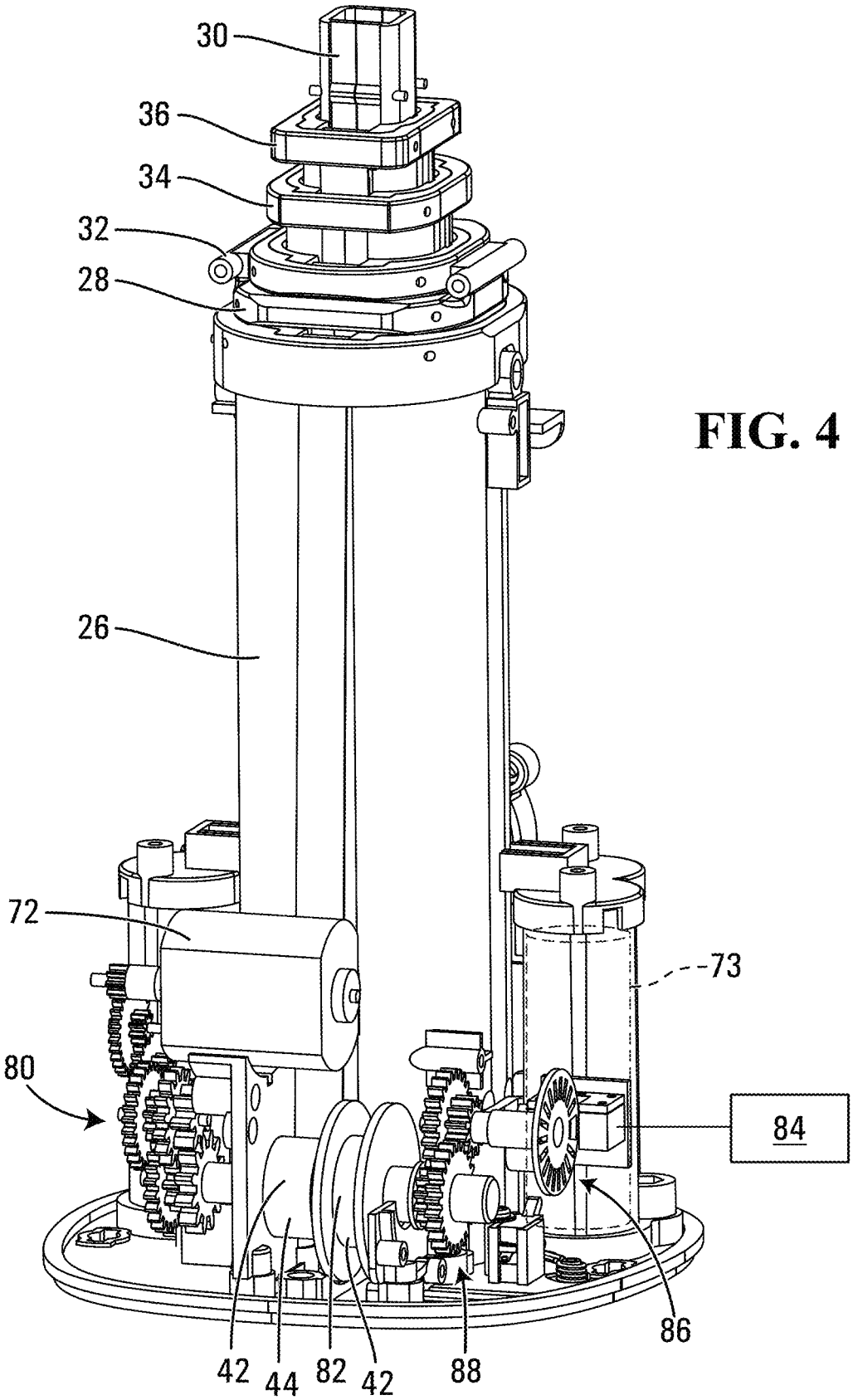
FIG. 4 is a perspective view of some internal elements from the extensible object shown in FIG. 2.
Figure 5:
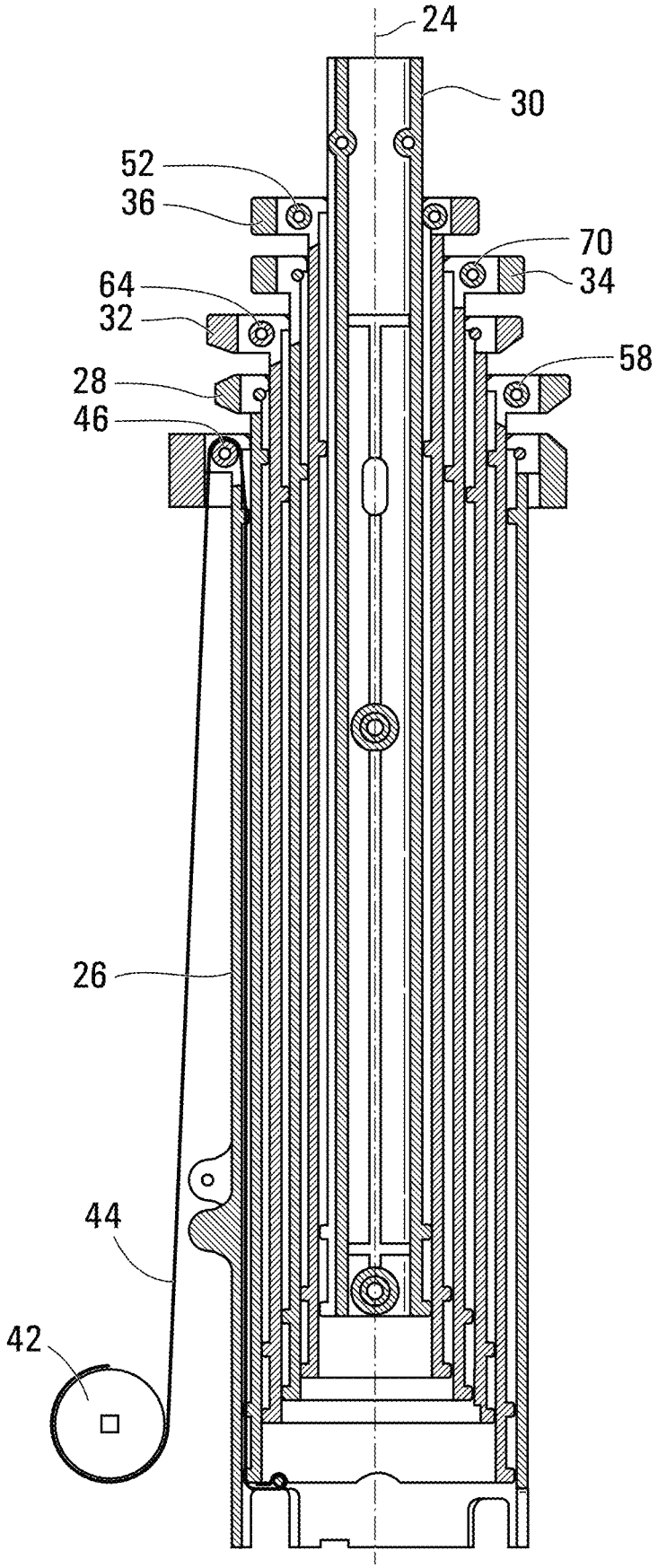
FIG. 5 is a sectional elevation view of the internal elements from the extensible object shown in FIG. 4.
Figure 7:
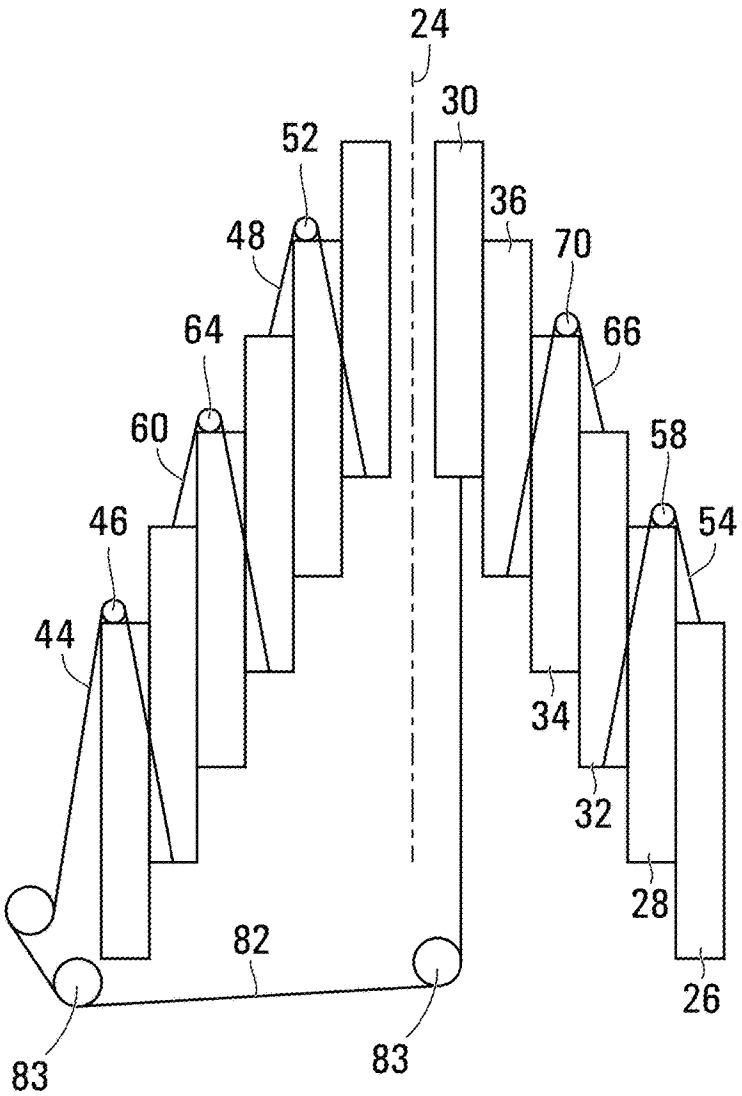
FIG. 7 is another sectional elevation view of the simplified version of the internal elements from the extensible object shown in FIG. 5, in a partially extended position.
Figure 6:
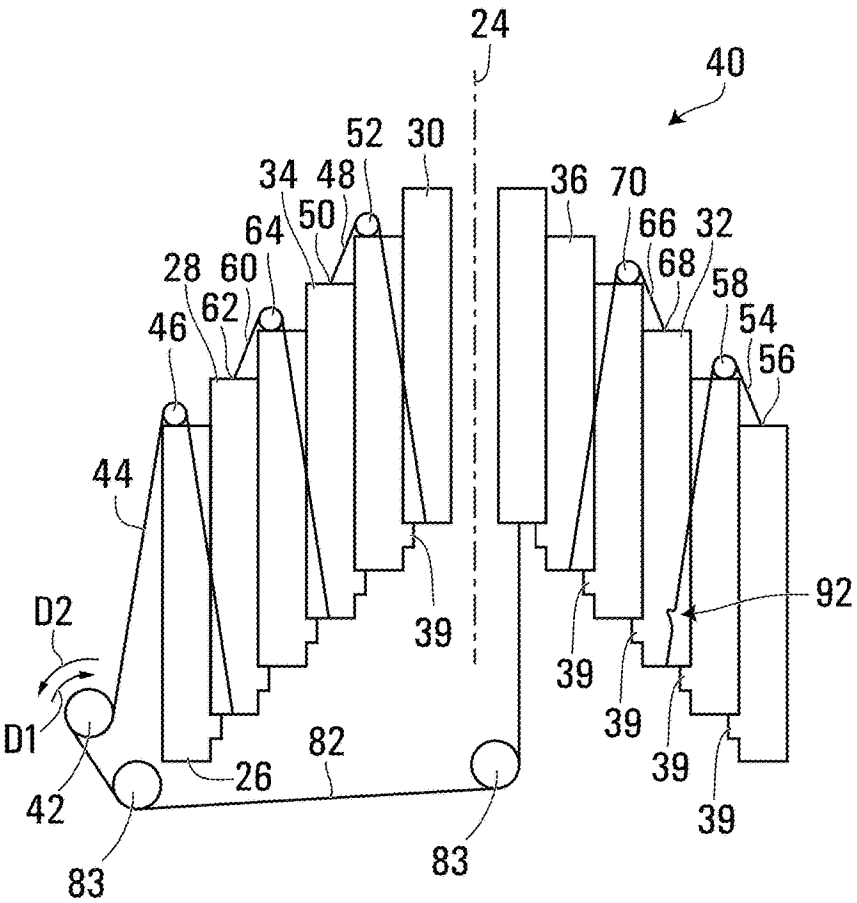
FIG. 6 is a sectional elevation view of a simplified version of the internal elements from the extensible object shown in FIG. 5, in the retracted position.
Figure 8:
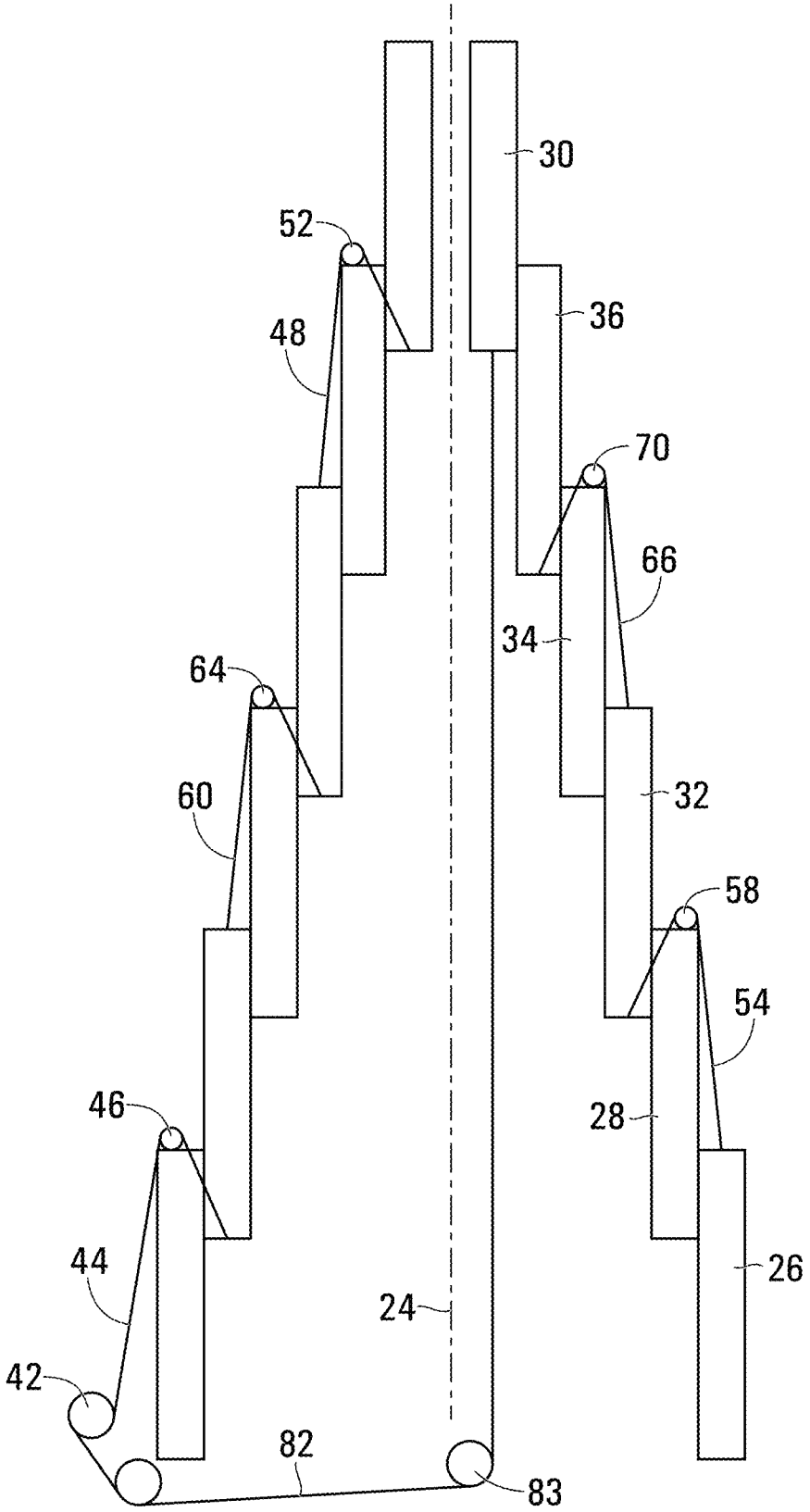
FIG. 8 is another sectional elevation view of the simplified version of the internal elements from the extensible object shown in FIG. 5, in a partially extended position.

FIGS. 4, 5, 9 and 10 show representations of extension members and the base 26 which may be manufactured of the extensible object 14, whereas FIGS. 6, 7 and 8 show the extension members and the base in a more schematic, simplified form for greater clarity.

Each extension member may be supported on the extension member preceding it towards the base 26. Thus, the second extension member 30 may be supported on a projection 39 on the fifth extension member 36, which in turn may be supported on a projection 39 on the fourth extension member 34, which in turn may be supported on a projection 39 on the third extension member 32, which in turn may be supported on a projection 39 on the first extension member 28, which in turn may be supported on a projection 39 on the base 26. The projection 39 is shown as being a cylindrical member in FIGS. 2 and 5. In FIG. 6 the projections 39 are shown as a lip 39 extending radially inwardly from the inner face of each extension member and the base 26, except for the second extension member 30 which does not support a further extension member thereon. The other figures do not show the projections 39.

Figure 9:
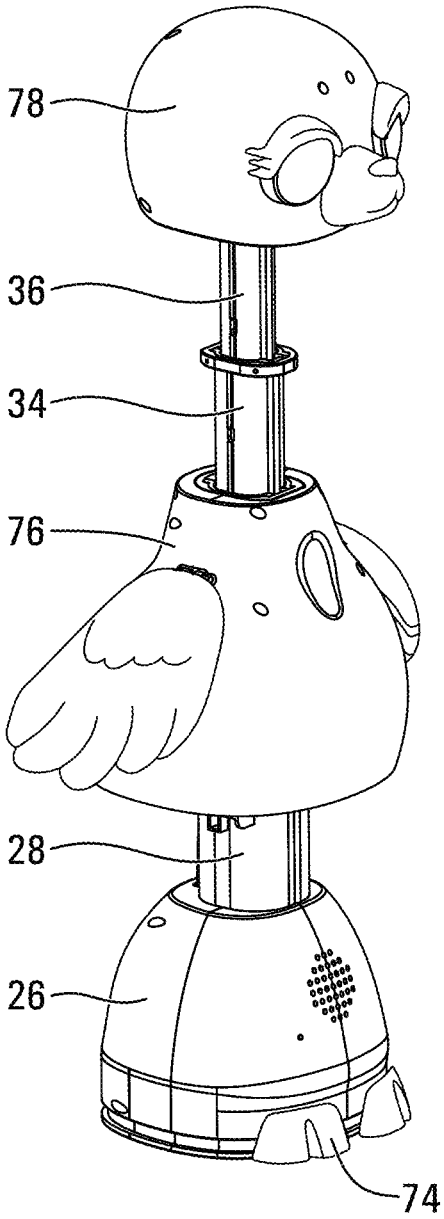
FIG. 9 is a perspective exploded view of the extensible object shown in FIG. 3, in a fully extended position.

FIGS. 7 and 9 show views of the extension members at an intermediate position between the retracted and extended positions.

An extension mechanism 40 is provided and is operable to drive the first extension member 28 towards the extended position for the first extension member 28 and to drive the second extension member 30 towards the extended position for the second extension member 30.

The extension mechanism 40 may include at least one drum 42. In the example shown in FIG. 4, the extension mechanism 40 includes two drums 42. However, for consistency, the term 'at least one' drum will be used when referring to this element. The extension mechanism 40 further includes a first extension drive cable 44 connected between the at least one drum 42 and the first extension member 28 and passing over a first extension drive cable pulley 46 on the base 26. The extension mechanism 40 further includes a second extension drive cable 48 connected between a second extension drive cable anchor point 50 and the second extension member 30 and passing over a second extension drive cable pulley 52 that is movable by movement of the first extension member 28. In the present example, the second extension drive cable anchor point 50 is a point on the fourth extension member 34, and the second extension drive cable pulley 52 is provided on the fifth extension member 36.

In the present example, the extension mechanism 40 further includes a third extension drive cable 54 connected between a third extension drive cable anchor point 56 (e.g. a point on the base 26) and the third extension member 32 and passing over a third extension drive cable pulley 58 that is movable by movement of the first extension member 28 (and which is in the present example provided on the first extension member 28).

In the present example, the extension mechanism 40 further includes a fourth extension drive cable 60 connected between a fourth extension drive cable anchor point 62 (e.g. a point on the first extension member 28) and the fourth extension member 34 and passing over a fourth extension drive cable pulley 64 that is movable by movement of the first extension member 28 (and which is in the present example provided on the third extension member 32).

In the present example, the extension mechanism 40 further includes a fifth extension drive cable 66 connected between a fifth extension drive cable anchor point 68 (e.g. a point on the third extension member 32) and the fifth extension member 36 and passing over a fifth extension drive cable pulley 70 that is movable by movement of the first extension member 28 (and which is in the present example provided on the fourth extension member 32).

The aforementioned pulleys may optionally be rotatable, or may alternatively be stationary members that are of suitably low friction not to abrade the cables sliding thereon.

In the present example, the first, second, third, fourth and fifth extension drive cables are in the form of ribbons so as to have strength while maintaining a low thickness. However, the extension drive cables may have any other suitable form.

In the present example, the extensible object 14 is a representation of a character (a bird), and includes a representation of feet 74 of the character on the base 26, a representation of a torso 76 of the character on the third extension member 32, and includes a representation of a head 78 of the character on the second extension member 30.

An extension mechanism power source 72 is operatively connected to the at least one drum 42 to rotate the at least one drum 42 in a first rotation direction D1 shown in FIGS. 5 and 6, so as to wind the first extension drive cable 44 onto the at least one drum 42, thereby driving the first extension member 28 toward the extended position for the first extension member 28, which in turn drives movement of the second extension drive cable pulley 52, which in turn drives the second extension drive cable 48 to drive movement of the second extension member 30 relative to the first extension member 28.

The extension mechanism power source 72 may be any suitable power source. For example, it may be an electric motor that is operatively connected to the at least one drum 42 via a plurality of gears 80. The electric motor may be driven by one or more batteries 73 (shown in dashed lines in FIG. 4). In an alternative embodiment (not shown) it may be a hand crank that is operatively connected to the at least one drum 42 either directly or alternatively via one or more gears.

In some embodiments, the extension mechanism 40 further includes a retraction drive cable 82 connected between the at least one drum 42 and the second extension member 30. Idler pulleys 83 are provided as needed to route the retraction drive cable 82 to avoid interference with other components. This is best seen in FIGS. 6-8. Rotation of the at least one drum 42 in the first rotational direction winds the first extension drive cable 44 onto the at least one drum 42 and pays out the retraction drive cable 82 from the at least one drum 42, as can be seen in the progression of the views from FIG. 6 to FIG. 8. Rotation of the at least one drum 42 in a second rotational direction D2 pays out the first extension drive cable 44 from the at least one drum 42 and winds the retraction drive cable 82 onto the at least one drum 42, thereby driving the second extension member 30 towards the retracted position for the second extension member 30, which in turn drives movement of the first extension drive cable pulley 46, which in turn drives the first extension drive cable 44 to drive movement of the first extension member 28 relative to the first extension member 30. The at least one drum 42 may have a different diameter for the first extension drive cable 44 than for the retraction drive cable 82, as needed since the first extension drive cable 44 and the retraction drive cable pay out or wind in by differing amounts relative to one another, based on several factors including how many extension members are provided in the extensible object 14. Thus, it will be understood that the at least one drum 42 is shown only schematically FIGS. 6-8.

While the provision of the retraction drive cable 82 ensures positively that the extensible object 14 is driven by the extension mechanism power source 72 to move to the retracted position for the extensible object 14, it is alternatively possible to not provide the retraction drive cable 82. In such an embodiment, rotation of the at least one drum 42 in the second rotational direction D2 pays out the first extension drive cable 44 from the at least one drum 42, thereby and permits gravity to drive the second extension member 30 towards the retracted position for the second extension member 30, which in turn drives movement of the first extension drive cable pulley 46, which in turn drives the first extension drive cable 44 to drive movement of the first extension member 28 relative to the first extension member 30.

In FIG. 4 only the cable 44 is shown, and in FIG. 5, only the cables 44 and 82 are shown. The other cables are shown in FIGS. 6-8.

A controller 84 may be provided to control the operation of the extension mechanism power source 72. An encoder 86 may be provided and is connected to the controller 84 to send signals thereto. The encoder 86 may also be connected to the at least one drum 42 by one or more gears 88 as shown, so as to control the rotational speed of the encoder wheel to suit the needs of the controller 84. The controller 84 may control the speed and direction of the electric motor.

Figure 10:
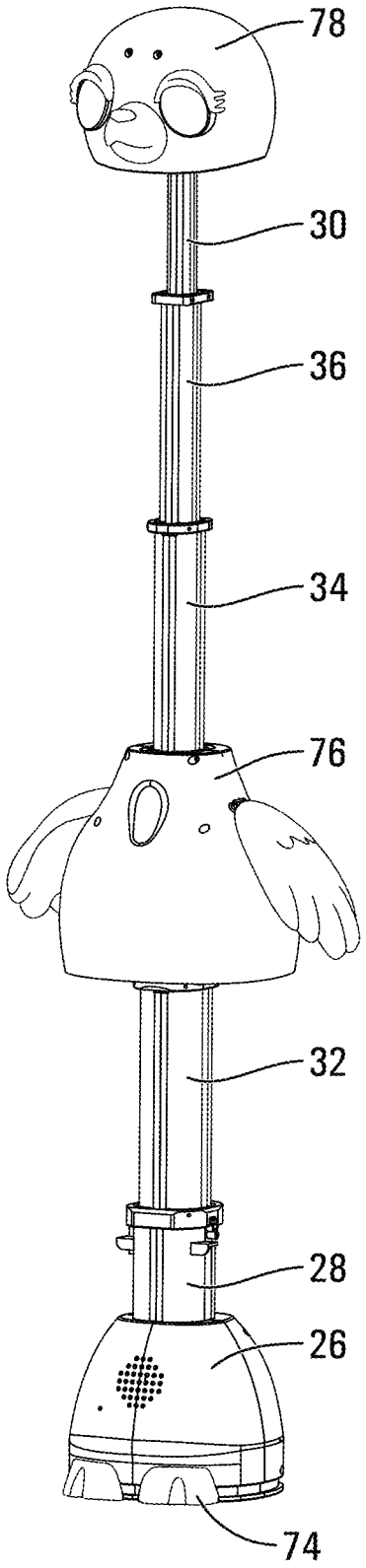
FIG. 10 is a perspective exploded view of the extensible object shown in FIG. 3, in a fully extended position.

FIGS. 3, 4, 5 and 6 show the extensible object 14 with the extension members in the retracted positions. FIGS. 7 and 9 show the extensible object 14 with the extension members in the aforementioned intermediate positions between the retracted positions and the extended positions. FIGS. 8 and 10 shown the extensible object 14 with the extension members in the extended positions. When all the extension members are in the retracted positions the extensible object 14 may be said to be in a retracted position for the extensible object 14. When all the extension members are in the extended positions the extensible object 14 may be said to be in an extended position for the extensible object 14.

Figure 15:
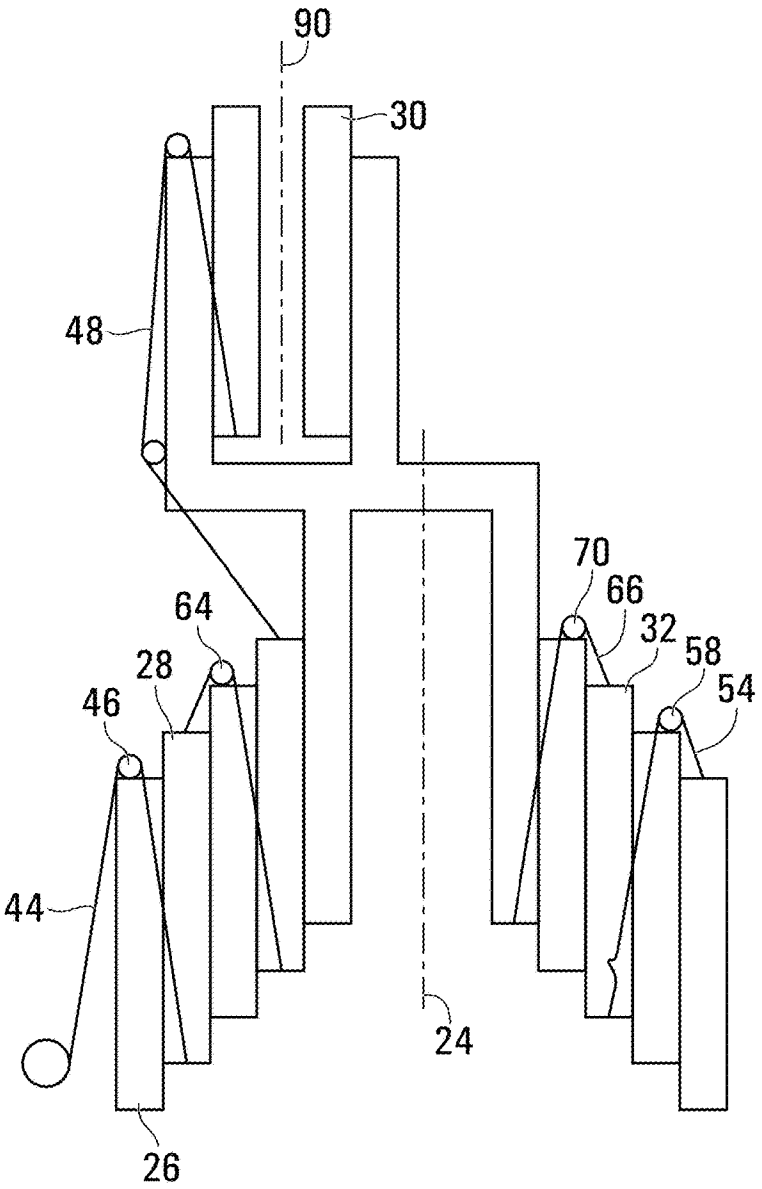
FIG. 15 is a sectional elevation view of a simplified version of internal elements from another extensible object that is capable of extending along one axis, in a retracted position.

In the embodiment shown in FIGS. 4-10, the extension members are all coaxial. However, in the embodiment shown in FIG. 15, the second extension member 30 is non-coaxial relative to the first extension member 28. The axis of the second extension member 30 is shown at 90.

In the embodiment shown, the extension mechanism 40 is operatively connected to the second extension member 30 via a lost motion connection 92 having a selected amount of lost motion. The lost motion connection 42 facilitates the breakout of the extensible object 14 from the housing 12. More specifically, it will be understood that a greater amount of torque is needed to drive the movement of all the extension members relative to one another, than is required to drive the first extension member 30 while it supports the other extension members. Accordingly, it is easier for the electric motor to drive the extension members when there is a lost motion connection 92 in order to break the housing 12 (or even just to open the housing in certain embodiments). Providing the lost motion connection 92 permits this while still permitting the electric motor to still be used to drive the second extension member (and the third, fourth and fifth extension members once the lost motion in the lost motion connection 92 is consumed.

The lost motion connection 92 may be formed in any suitable way. For example, the lost motion connection 92 in the present example includes an excess amount of length of the third extension drive cable 54 between the base 26 and the third extension member 32, such that there is a selected amount of slack in the third extension drive cable 54 when the first and third extension members 28 and 23 are in the retracted positions for the first and third extension members 28 and 32, and wherein the third extension member 32 is supported against a limit member 39 on the first extension member 28 so as to be driven thereby and to drive the second extension member 30 even when there is slack in the third extension drive cable 54.

The second extension drive cable 48 drives movement of the second extension member 30 relative to the first extension member 28 upon consumption of the lost motion in the lost motion connection 92.

Figure 11:
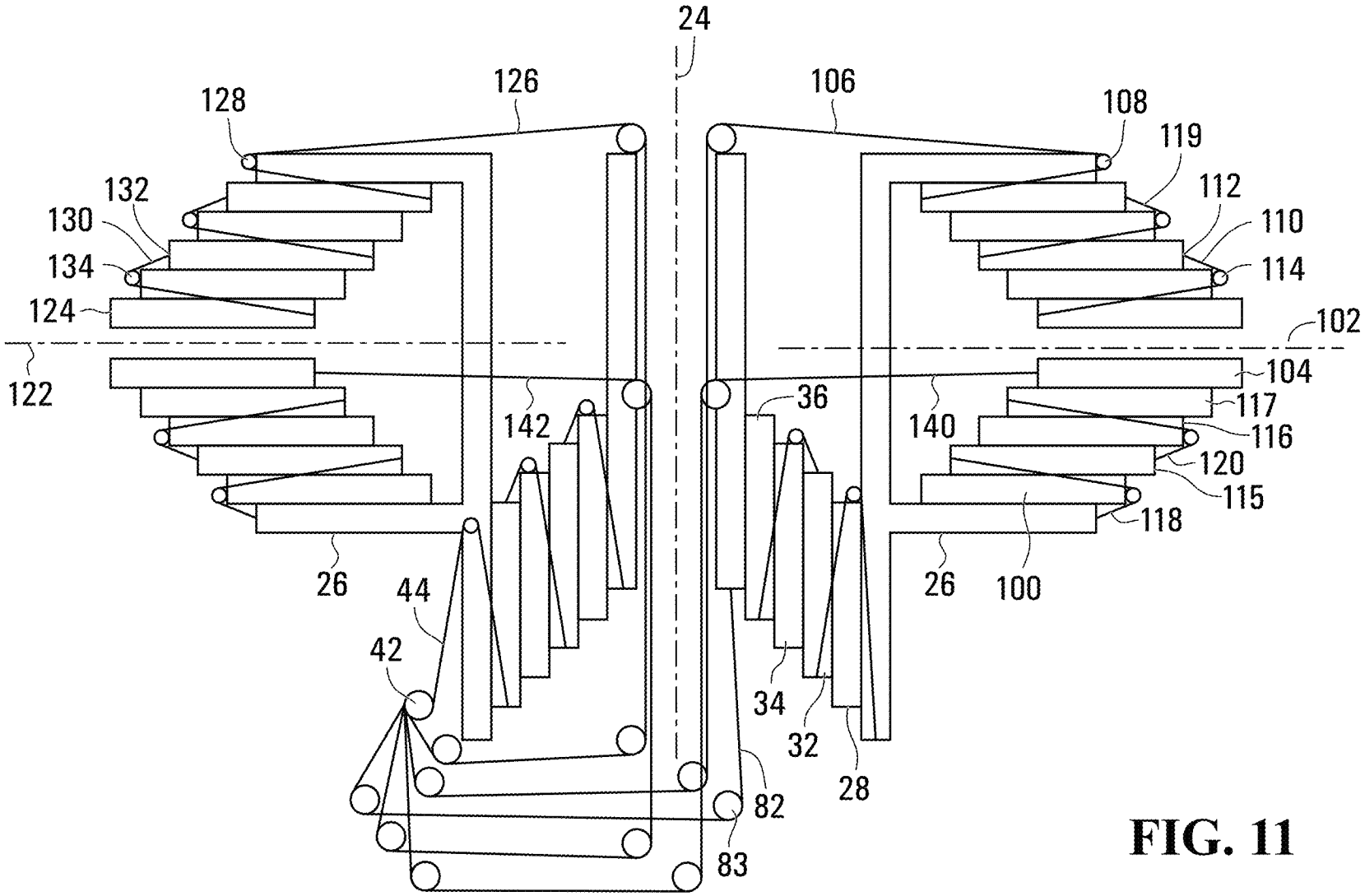
FIG. 11 is a sectional elevation view of a simplified version of internal elements from an extensible object that is capable of extending along two axes, in a retracted position.
Figure 12:
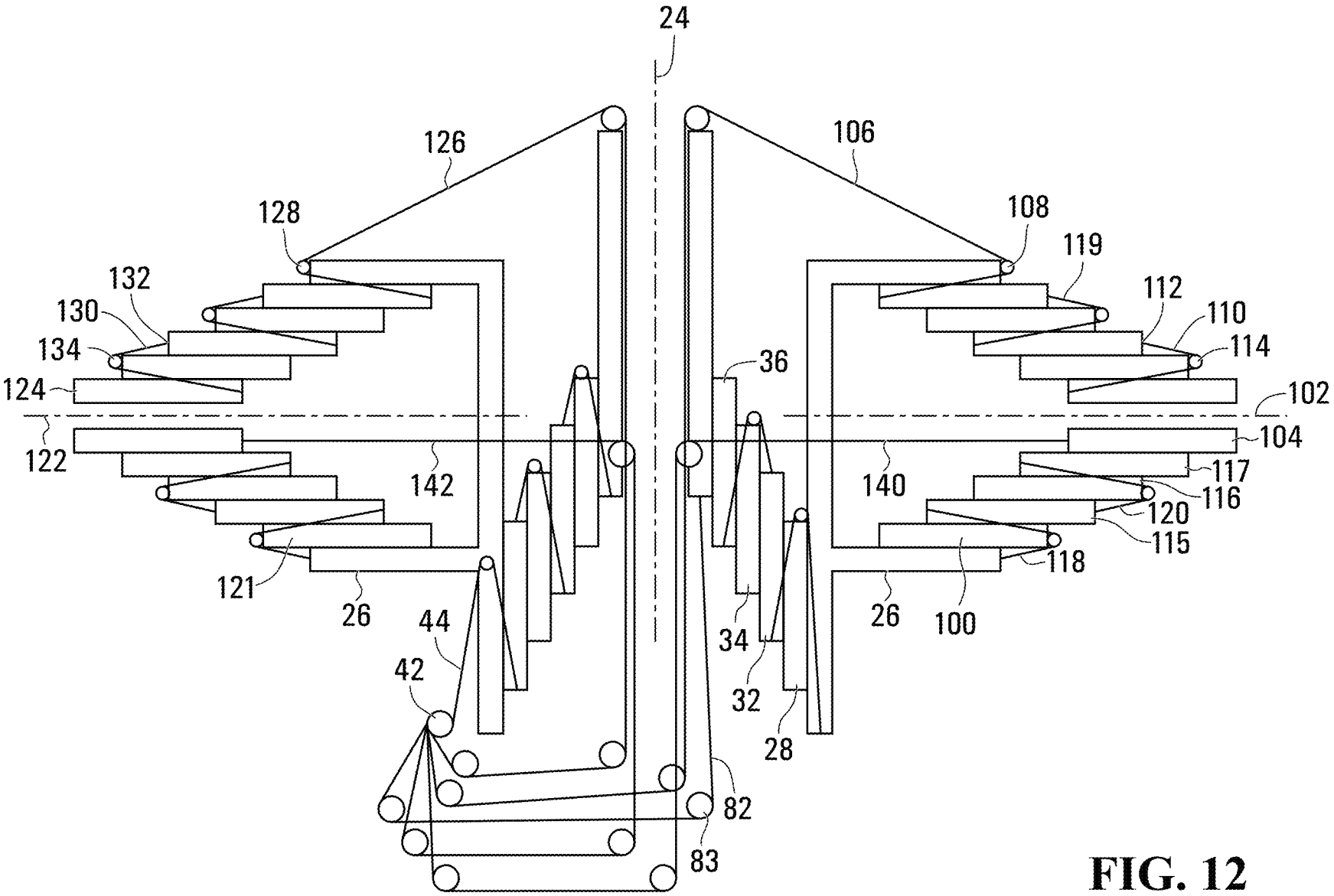
FIG. 12 is a sectional elevation view of a simplified version of the internal elements from the extensible object shown in FIG. 11, in a fully extended position.
Figure 13:
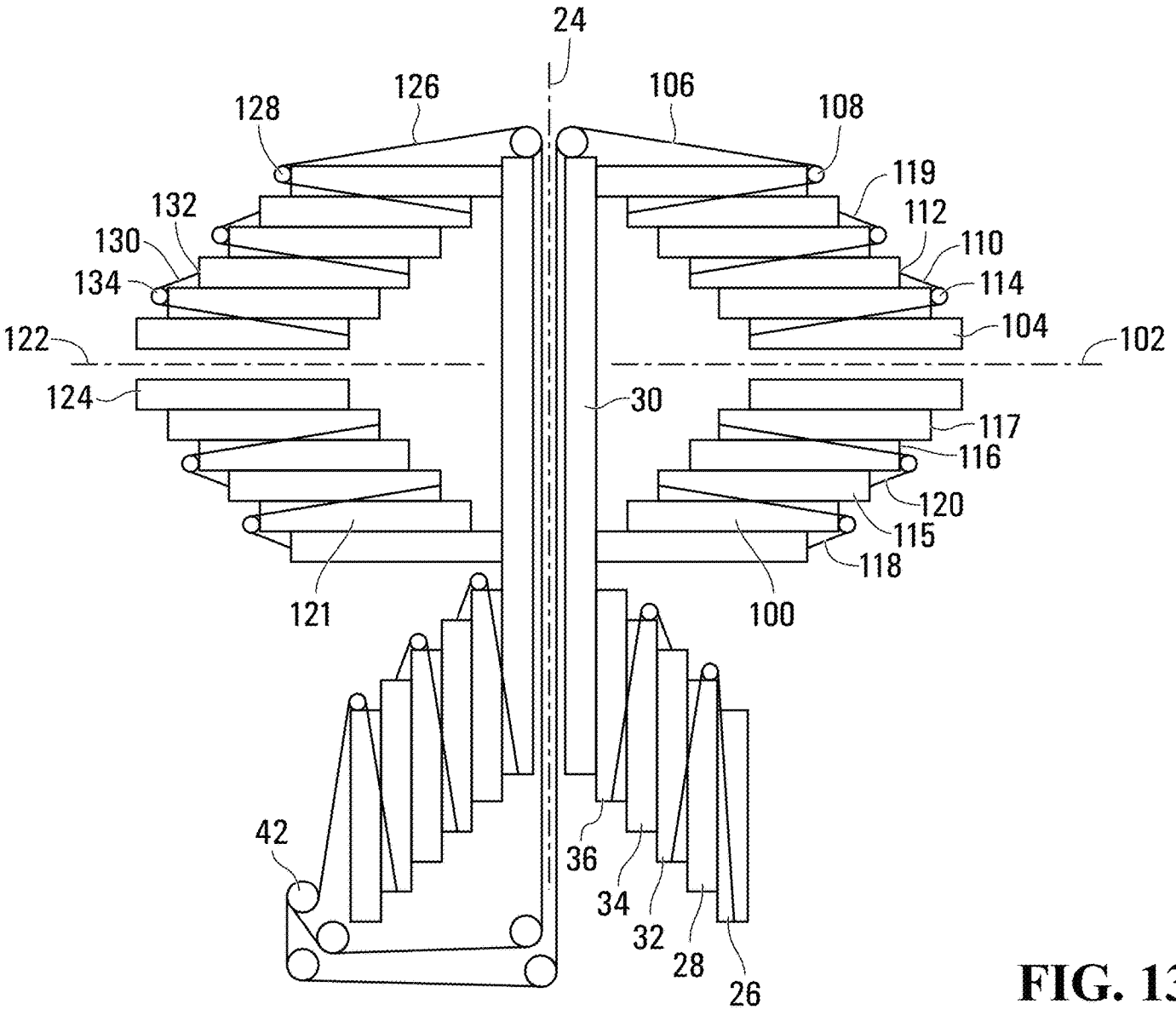
FIG. 13 is a sectional elevation view of a simplified version of internal elements from another extensible object that is capable of extending along two axes, in a retracted position.
Figure 14:
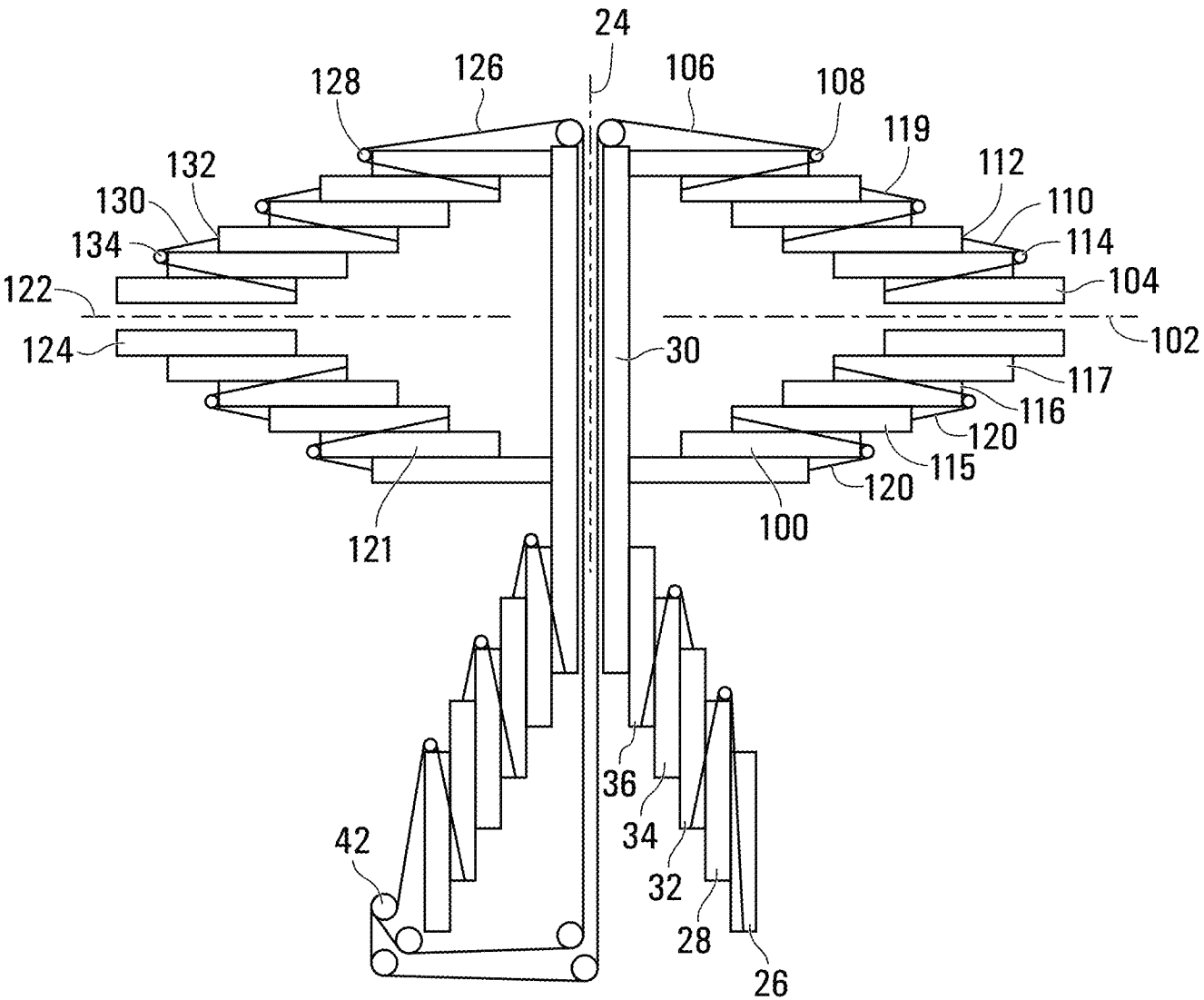
FIG. 14 is a sectional elevation view of a simplified version of the internal elements from the extensible object shown in FIG. 11, in a fully extended position.

FIGS. 11 and 12, and FIGS. 13 and 14 show embodiments in which the extension members 28, 30, 32, 34 and 36 are first-axis extension members, such that the extensible object 14 extends along a first axis 24, and in which the extensible object 14 includes a first second-axis extension member 100 that is movable relative to the base 26 along a second axis 102 that is non-coaxial with the first axis 24, between a retracted position (FIGS. 11 and 13) for the first second-axis extension member 100 and an extended position (FIGS. 12 and 14) for the first second-axis extension member 100, and a second second-axis extension member 104 that is movable relative to the first second-axis extension member 100 between a retracted position (FIGS. 11 and 13) for the second second-axis extension member 104 and an extended position (FIGS. 12 and 14) for the second second-axis extension member 104. The first and second extension drive cables 44 and 48 are first and second first-axis extension drive cables, and the extension mechanism further includes a first second-axis extension drive cable 106 connected between the at least one drum 42 and the first second-axis extension member 100 and passing over a pulley 108, which may be on the base 26 (FIGS. 11 and 12) or which may be on another member such as one of the first-axis extension members (FIGS. 13 and 14). The extension mechanism further includes a second second-axis extension drive cable 110 connected between a second second-axis extension drive cable anchor point 112 and the second second-axis extension member 104 and passing over a second second-axis extension drive cable pulley 114 that is movable by movement of the first second-axis extension member 100. Further second-axis extension members and second-axis extension drive cables may be provided and are shown at 115, 116 and 117 (second-axis extension members), and 118, 119 and 120 (second-axis extension drive cables) in the examples shown in FIGS. 11-14. The second-axis extension members 115, 116 and 117 and the second-axis extension drive cables 118, 119 and 120 may be analogous to the first-axis extension members 32, 32 and 36 and the first axis extension drive cables 54, 60 and 66, respectively, but act between the first and second second-axis extension members 100 and 104.

As a result, the extensible object 14 may be extensible along two axes. The axes 102 and 24 may be perpendicular to one another. As a result of having the two axes 24 and 102 be non-coaxial with one another, the extensible object 14 is able to grow in two dimensions, optionally by means of a single power source, such as a single electric motor.

In the examples shown in FIGS. 11-14, the extension mechanism also includes a first third-axis extension member 120, that is movable relative to the base 26 along a third axis 122 that is, in the present example, coaxial with the second axis 102, between a retracted position (FIGS. 11 and 13) for the first third-axis extension member 120 and an extended position (FIGS. 12 and 14) for the first third-axis extension member 120, and a second third-axis extension member 124 that is movable relative to the first third-axis extension member 120 between a retracted position (FIGS. 11 and 13) for the second third-axis extension member 124 and an extended position (FIGS. 12 and 14) for the second third-axis extension member 124. The extension mechanism further includes a first third-axis extension drive cable 126 connected between the at least one drum 42 and the first third-axis extension member 120 and passing over a pulley 128, which may be on the base 26 (FIGS. 11 and 12) or which may be on another member such as one of the first-axis extension members (FIGS. 13 and 14). The extension mechanism further includes a second third-axis extension drive cable 130 connected between a second third-axis extension drive cable anchor point 132 and the second third-axis extension member 124 and passing over a second third-axis extension drive cable pulley 134 that is movable by movement of the first third-axis extension member 120.

While the third-axis extension members 120 and 124 extend along a third axis 122 that is co-axial with the second axis 102, it is alternatively possible for the third axis to be non-coplanar with the first and second axes 24 and 102. For example, the three axes may all be orthogonal to one another. As a result of having the three axes 24, 102 and 122 be non-coplanar with each other, the extensible object 14 is able to grow in three dimensions, optionally by means of a single power source, such as a single electric motor.

In the example shown in FIGS. 11 and 12, first, second and third retraction drive cables are shown at 82, 140 and 142. These retraction drive cables 82, 140 and 142 pass over suitable pulleys 144 that are positioned to rotate on the frame 26, or on another member such as one of the first-axis extension members, and connect at their free ends to the second first-axis extension member 30, the second second-axis extension member 104, and to the second third-axis extension member 124, respectively. These retraction drive cables 82, 140 and 142 are driven by the extension mechanism power source 72 (optionally on individual pulleys of whatever sizes are suitable). The operation of these retraction drive cables 82, 140 and 142 may be similar to the operation of the retraction drive cable 82 in FIGS. 6-8. Retraction drive cables 82, 140 and 142 and associated pulleys are not shown in FIGS. 13 and 14, so as not to complicate the figures. It will be understood that they are present in those embodiments, however.

In the embodiments shown in FIGS. 11-14, it will be noted that the extension of the first-axis extension members and the extension of the second-axis extension members occur in parallel with one another. It is alternatively possible, however, for the extension of the first-axis extension members to take place prior to, or after, the extension of the second-axis extension members, such that the extension of the first-axis extension members and the extension of the second-axis extension members are separated from one another by at least some small moment of time. This permits the extensible object to carry out extension along one of the first and second axes without necessarily having to carry out extension along the other of the first and second axes. This can be referred to as series operation of the first-axis extension members and second-axis extension members.

In the embodiments shown and described herein, it will be noted that the toy assembly 10 may be provided with a mechanism to rotate the extensible object 14 while it is in the housing 12 during the breakout process. For example, the extensible object 14 may stand on a platform that is rotatable, and which is driven by a platform drive source, such as an electric motor that is separate from the extension mechanism power source 72. Operation of the platform drive source can rotate the extensible object 14 to a position, at which point the extension mechanism power source 72 can drive the extensible object 14 to extend by a small amount in order to break the housing 12 slightly, (thereby appearing as if a character is trying to peck its way out, or otherwise break its way out of the housing 12. The extension mechanism power source 72 can then retract the extensible object 14, at which point the platform drive source can drive the extensible object 14 to a new position, in order to extend itself again, by a small amount, so as to appear that the character is attempting to break out in a different location. After a plurality of small extensions and subsequent retractions, and rotations to new positions, the extension mechanism power source 72 may be driven to extend the extensible object 14 more fully so as to break out of the housing 12.

While it has been described for the toy assembly housing 12 to be broken by the toy character 14 during a breakout process, it will be noted that this need not be the case. The breakout process could alternatively involve the toy character 14 opening the toy assembly housing 12, such as by pushing open a lid on the toy assembly housing 12 that is hingedly connected to a lower portion of the toy assembly housing 12, or by popping off a lid that is snap fit to a lower portion of the toy assembly housing 12.

Persons skilled in the art will appreciate that there are yet more alternative implementations and modifications possible, and that the above examples are only illustrations of one or more implementations. The scope, therefore, is only to be limited by the claims appended hereto and any amendments made thereto.

The invention claimed is:

1. A toy assembly, comprising:

a toy assembly housing; and an extensible object inside the toy assembly housing, wherein the extensible object includes a base, a first extension member that is movable relative to the base between a retracted position for the first extension member and an extended position for the first extension member, and a second extension member that is movable relative to the first extension member between a retracted position for the second extension member and an extended position for the second extension member;

an extension mechanism that is operable to drive the first extension member towards the extended position for the first extension member and to drive the second extension member towards the extended position for the second extension member, wherein the extension mechanism is operatively connected to the second extension member via a lost motion connection having a selected amount of lost motion; and an extension mechanism power source operatively connected to the extension mechanism to drive the extension mechanism, wherein, when the extensible object is in a home position, driving of the extension mechanism by the extension mechanism power source drives the first extension member towards the extended position for the first extension member to break or open the toy assembly housing to expose the extensible object while consuming at least a portion of the lost motion in the lost motion connection so as to prevent movement of the second extension member towards the extended position for the second extension member, while breaking or opening the toy assembly housing, wherein, upon consuming an entirety of the lost motion in the lost motion connection, further driving of the extension mechanism by the extension mechanism power source drives both the first and second extension members towards the extended positions for the first and second extension members, wherein the extensible object includes at least one drum, a first extension drive cable connected between the at least one drum and the first extension member and passing over a first extension drive cable pulley on the base, a second extension drive cable connected between a second extension drive cable anchor point and the second extension member and passing over a second extension drive cable pulley that is movable by movement of the first extension member, wherein the extension mechanism power source is operatively connected to the at least one drum to rotate the at least one drum in a first rotation direction so as to wind the first extension drive cable onto the at least one drum, thereby driving the first extension member toward the extended position for the first extension member, which in turn drives movement of the second extension drive cable pulley, which in turn drives the second extension drive cable to drive movement of the second extension member relative to the first extension member upon consumption of the lost motion in the lost motion connection, wherein the extensible object includes a third extension member that is movable relative to the first extension member between a retracted position for the third extension member and an extended position for the third extension member, wherein the extension mechanism includes a third extension drive cable connected between the base and the third extension member and passing over a third extension drive cable pulley on the first extension member, and wherein the lost motion connection includes an excess amount of length of the third extension drive cable between the base and the third extension member, such that there is a selected amount of slack in the third extension drive cable when the first and third extension members are in the retracted positions for the first and third extension members, and wherein the third extension member is supported against a limit member on the first extension member so as to be driven thereby and to drive the second extension member even when there is slack in the third extension drive cable.

2. A toy assembly as claimed in claim 1, wherein the extensible object is in the form of a character, and wherein the base includes a representation of feet of the character, the third extension member includes a representation of a torso of the character and the second extension member includes a representation of a head of the character.

3. A toy assembly as claimed in claim 1, wherein the extension mechanism includes:

a retraction drive cable connected between the at least one drum and the second extension member, wherein rotation of the at least one drum in the first rotational direction winds the first extension drive cable onto the at least one drum and pays out the retraction drive cable from the at least one drum, and wherein rotation of the at least one drum in a second rotational direction pays out the first extension drive cable from the at least one drum and winds the retraction drive cable onto the at least one drum, thereby driving the second extension member towards the retracted position for the second extension member, which in turn drives movement of the first extension drive cable pulley, which in turn drives the first extension drive cable to drive movement of the first extension member relative to the second extension member.

4. A toy assembly as claimed in claim 1, wherein the second extension member is coaxial with the first extension member.

5. A toy assembly as claimed in claim 1, wherein the second extension member is non-coaxial with the first extension member.

6. A toy assembly as claimed in claim 1, wherein the extension mechanism power source includes one electric motor.

7. An extensible object, comprising:

a base;

a first extension member that is movable relative to the base between a retracted position for the first extension member and an extended position for the first extension member;

a second extension member that is movable relative to the first extension member between a retracted position for the second extension member and an extended position for the second extension member;

an extension mechanism that is operable to drive the first extension member towards the extended position for the first extension member and to drive the second extension member towards the extended position for the second extension member, wherein the extension mechanism includes at least one drum, a first extension drive cable connected between the at least one drum and the first extension member and passing over a pulley on the base, and a second extension drive cable connected between a second extension drive cable anchor point and the second extension member and passing over a second extension drive cable pulley on the first extension member; and wherein the extension mechanism power source is operatively connected to the at least one drum to rotate the at least one drum in a first rotation direction so as to wind the first extension drive cable onto the at least one drum, thereby driving the first extension member toward the extended position for the first extension member, which in turn drives movement of the second extension drive cable pulley, which in turn drives the second extension drive cable to drive movement of the second extension member relative to the first extension member, wherein the first extension member is a first first-axis extension member that is movable relative to the base along a first axis, and wherein the second extension member is a second first-axis extension member that is movable relative to the first first-axis extension member along the first axis, and wherein the extensible object includes:

a first second-axis extension member that is movable relative to the base along a second axis that is non-coaxial with the first axis, between a retracted position for the first second-axis extension member and an extended position for the first second-axis extension member;

a second second-axis extension member that is movable relative to the first second-axis extension member between a retracted position for the second second-axis extension member and an extended position for the second second-axis extension member; wherein the first extension drive cable is a first first-axis extension drive cable and wherein the second extension drive cable is a second first-axis extension drive cable, wherein the extension mechanism further includes:

a first second-axis extension drive cable connected between the at least one drum and the first second-axis extension member and passing over a pulley on the base, and a second second-axis extension drive cable connected between a second second-axis extension drive cable anchor point and the second second-axis extension member and passing over a second second-axis extension drive cable pulley that is movable by movement of the first second-axis extension member;

wherein rotation of the at least one drum in the first rotation direction winds the first second-axis extension drive cable onto the at least one drum, thereby driving the first second-axis extension member toward the extended position for the first second-axis extension member, which in turn drives movement of the second second-axis extension drive cable pulley, which in turn drives the second second-axis extension drive cable to drive movement of the second second-axis extension member relative to the first second-axis extension member.

8. An extensible object as claimed in claim 7, wherein the second axis is perpendicular to the first axis.

* * * * *